US005255600A

United States Patent [19]

Hamu

[11] Patent Number: 5,255,600

[45] Date of Patent: * Oct. 26, 1993

[54] REINFORCED PRINTING FRAME STRUCTURE

[76] Inventor: Kaino J. Hamu, 16061 Dominica Cir., Huntington Beach, Calif. 92649

[ * ] Notice: The portion of the term of this patent subsequent to Mar. 24, 2009 has been disclaimed.

[21] Appl. No.: 828,032

[22] Filed: Jan. 30, 1992

[51] Int. Cl.[5] ..... B05C 17/08

[52] U.S. Cl. ..... 101/127.1; 101/128.1

[58] Field of Search ..... 101/127.1, 128.1, 474

[56] References Cited

U.S. PATENT DOCUMENTS

| | | | |
|---|---|---|---|
| 3,601,912 | 8/1971 | Dubbs | 101/127.1 |
| 4,041,861 | 8/1977 | Alter | 101/128.4 |
| 4,430,815 | 2/1984 | Wulc | 101/127.1 |
| 4,525,909 | 7/1985 | Newman | 38/102.1 |
| 5,097,761 | 3/1992 | Hamu | 101/127.1 |

FOREIGN PATENT DOCUMENTS

| | | | |
|---|---|---|---|
| 2087311 | 5/1982 | United Kingdom | 101/128.1 |

*Primary Examiner*—Edgar S. Burr
*Assistant Examiner*—Anthony H. Nguyen
*Attorney, Agent, or Firm*—Boniard I. Brown

[57] ABSTRACT

A relatively light weight screen printing frame structure particularly adapted for use in making relatively large area screen prints. The frame structure has an open rectangular screen frame proper including truss frame members along at least two opposing sides of the frame which mount screen gripping and tensioning means and have a unique open truss construction which resists bending of these frame members by the screen tension forces and other forces acting on these members during screen printing operations. In the preferred screen frame structure described, the reinforcing truss structures of the truss frame members are located inwardly of the screen gripping and tensioning means in such a way as to minimize the overall size and weight of a frame structure for supporting a printing screen of any given useful area.

15 Claims, 1 Drawing Sheet

REINFORCED PRINTING FRAME STRUCTURE

BACKGROUND OF THE INVENTION

1. Field of the Invention

This invention relates generally to so-called silk screen printing equipment and more particularly to a novel reinforced screen printing frame primarily intended for very large area printing applications.

2. Reference to Copending Applications

Reference is made to my copending application Ser. No. 07/576,673, filed Aug. 31, 1990.

3. Prior Art

The art of screen printing, commonly referred to as silk screen printing, is very well known and extensively used for a vast assortment of printing applications and hence need not be elaborately explained in this disclosure. Suffice it to say that screen printing involves the use of an open rectangular screen frame across one side of which is placed a printing screen having a pattern of open and blocked holes corresponding to the image to be printed. Along at least two opposite sides, and often along all four sides, of the screen frame are screen gripping and tensioning means, such as rollers, for gripping the screen edges and stretching the screen edgewise to a taut condition suitable for screen printing.

When printing a work surface, the screen frame is positioned so that the screen is located at the underside of the frame facing the work surface. A printing ink is spread across the upper side of the screen and is forced through the open holes in the screen onto the surface. This action depresses a major central portion of the screen into firm flat contact with the work surface as is essential to produce an acceptable screen print. The entire image formed on the screen is located within this central screen portion, and only this central screen portion is useable for screen printing. The attachment of the screen edges to the frame keeps the remaining border-like portion of the screen between its central useable portion and the gripped edges of the screen from flat contact with the work surface. Accordingly, this border portion of the screen, which may be on the order of 3 inches in width for a 20 inch frame opening, is unuseable for printing purposes. Many screen printing operations involve the sequential use of different printing screens and/or different color inks to produce a finished print.

The present invention is concerned with printing relatively large surface areas, such as areas on the order of 50 feet or more in length and several feet in width. One such large surface area printing application, for example, involves the printing of certain designs, indicia, and the like on a facing sheet for the interior of a Boeing airliner. In the past, it has been necessary to print these designs, indicia, etc. on several separate sheets which then must be applied in proper alignment to the airliner interior. Simultaneously printing of all the required designs and indicia on a single sheet in a single printing operation and application of this single sheet to the airliner is substantially more economical and results in a vastly superior airliner interior.

Up to the present time, it has been either impractical or totally impossible to make such large surface area screen prints. This is due to the fact that the existing screen frame structures are not sufficiently rigid to enable their construction in the large sizes necessary for large surface printing applications. Thus, the existing screen frame structures, if enlarged sufficiently for the large surface area screen printing applications contemplated in this invention, are subject to two modes of bending which seriously degrade the screen print quality. One bending mode is gravity-induced vertical bending or saging which occurs in a large frame of conventional construction when it is raised and lowered in the course of screen printing operations. Such a conventional printing frame on the order of 50 feet or more in length, for example, would sag several inches vertically at its center when lifted. The second bending mode to which a large screen frame of conventional construction is subject is inward bending of its long frame members in the plane of the frame by the tension forces in the stretched printing screen. Both of these modes of bending or deflection create non-uniform tension in the printing screen and thereby severe distortions in the resulting print.

SUMMARY OF THE INVENTION

This invention provides an improved screen printing frame structure for large surface area screen printing applications and including a screen frame proper which is uniquely constructed and arranged to resist either or both vertical bending or sagging of the frame when the frame structure is lifted in the course of screen printing operations and resist inward bending of the frame sides by printing screen tension when the screen is stretched. To this end, the screen frame includes frame members located along the four sides of the frame and rigidly joined to one another at the frame corners. These frame members define and bound a rectangular opening through the frame. At least the opposing frame members which are most subject to bending have a unique open truss construction which may be arranged to resist either or both types of frame bending modes referred to above. The frame members having such a truss construction are referred to herein as truss frame members. As will appear from the ensuing description, the preferred truss frame members have a unique, essentially inside truss arrangement wherein most of the reinforcing truss structures are located inwardly of the gripped edges of the printing screen and directly opposite the unuseable portion of the screen. This inside truss arrangement results in a screen frame structure which is relatively light in weight to facilitate handling of the frame structure during screen printing operation.

Each truss frame member of a present screen frame has an inner longitudinal truss portion along and bounding the adjacent side of the frame opening, an outer longitudinal truss portion laterally spaced from the inner truss member, and additional lateral truss portions joining the inner and outer truss portions in such a way as to form a plurality of triangular load bearing truss sections. These truss frame members may be arranged to resist either or both inward bending of these frame members in the plane of the screen frame by the tension force in the stretched printing screen and vertical bending or sagging of the screen frame when it is raised and lowered in the course of a screen printing operation.

Mounted on and extending lengthwise of at least two opposite frame members of the screen frame are means for gripping opposite edges of a printing screen extending across the normally bottom side of the frame and stretching the screen edgewise to the proper screen tension for screen printing. Screen gripping and tensioning means mounted on truss frame members of the frame are supported on and extend lengthwise of longitudinal truss portions of the truss frame members. The preferred screen gripping and tensioning means are rollers disposed within cavities which extend longitudinally through and open laterally through the normally undersides of longitudinal truss portions of the truss frame members.

As noted earlier, only the central portion of the printing screen is actually used to produce a screen print. The remaining border-like portion of the screen between the screen frame members and the usable central screen portion is unusable for screen printing. In the preferred screen frame embodiment described herein, the screen gripping and tensioning means are mounted on the outer longitudinal truss portions of the truss frame members so that these truss frame members extend laterally inward of the gripped edges of the printing screen directly opposite the unused border portion of the screen. The surfaces of the truss frame members which face this unused portion of the screen are spaced from the screen. Thus, most of the truss structures of the truss frame members are effectively located at the inside of the screen frame opposite the unused portion of the printing screen. This truss arrangement achieves reinforcement of the screen frame with minimum outside dimensions and weight of the frame for any given useable screen area.

DESCRIPTION OF THE PREFERRED EMBODIMENTS

Figure 1:
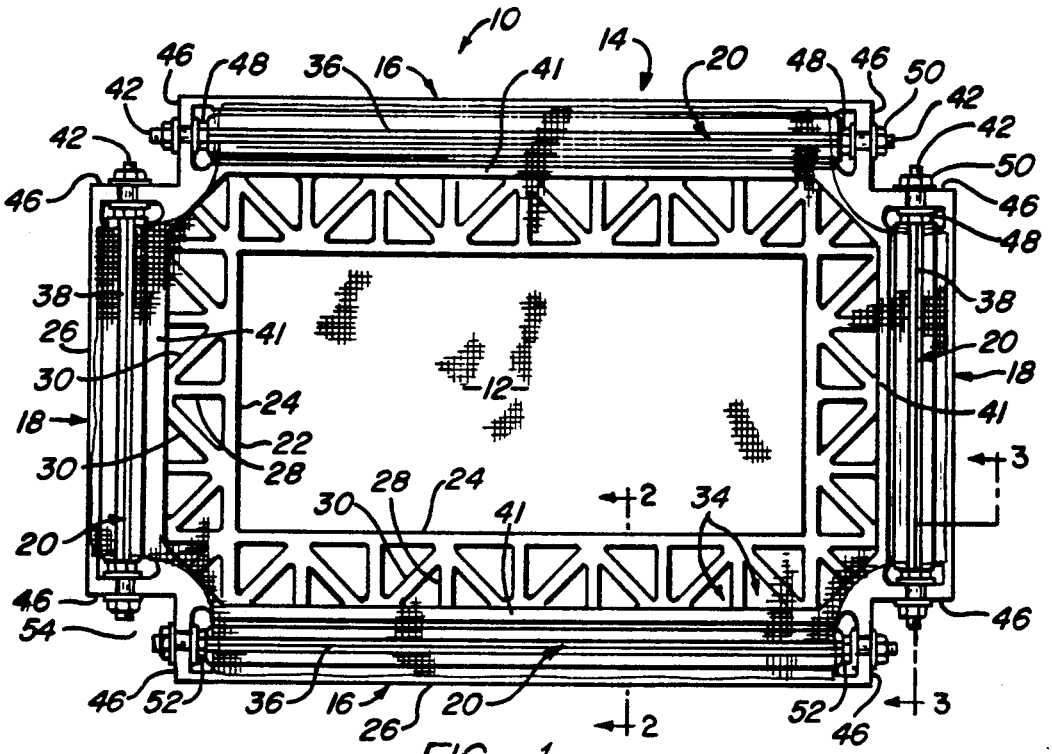
FIG. 1 is a plan view of the normally bottom side of a reinforced screen printing frame structure according to the invention.
Figure 2:
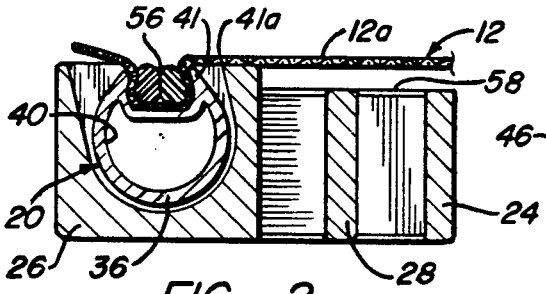
FIG. 2 is an enlarged section taken on line 2—2 in FIG. 1.
Figure 3:
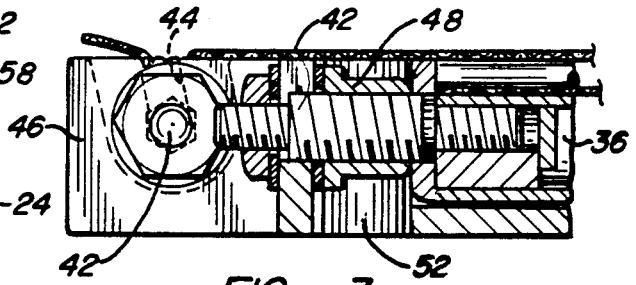
FIG. 3 is an enlarged section taken on line 3—3 in FIG. 1.

Turning now to FIGS. 1-3 of these drawings, there is illustrated a screen printing frame structure 10 according to the invention supporting a printing screen 12. The frame structure 10 includes a rectangular screen frame 14 proper composed of four frame members 16 and 18 along the four sides, respectively, of the frame and screen gripping and tensioning means 20 on at least certain of the frame members. The adjacent ends of the frame members are rigidly joined to one another at the four corners of the frame. The four frame members define and circumferentially bound a rectangular opening 22 though the frame. As described in more detail later, the screen gripping and tensioning means 20 are adapted to grip the edges of the screen 12 and stretch the screen edgewise across the normally underside of the frame 14 (i.e. the upper side shown in FIG. 1) and its opening 22.

As mentioned earlier, only a certain central area of a printing screen, such as the screen 12, is useable for screen printing. It was also mentioned that a screen frame structure according to this invention is intended primarily for printing relatively large surface areas. For example an area to be printed may measure 50 feet or more in length and several feet in width. For such use, the screen frame 14 will have a length and width such that the frame opening 22 is properly sized to provide the printing screen 12 with the desired useable central area.

Stretching of the printing screen 12 across the frame 14 by the screen tensioning means 20 produces bending loads on the frame members 16, 18 which tend to bow or bend them inwardly between their ends in the plane of the frame. This bending mode is referred to herein as an in-plane bending mode. Such bowing or bending of the screen frame 14 must be resisted because it creates non-uniform tension in the printing screen 12 and thereby degrades the screen print. During a screen printing operation, it is necessary to frequently raise and lower the screen frame structure 10. Gravity then produces vertical bending loads on the frame members 16, 18 which tend to cause these frame members to bow downwardly or sag between between their ends. This bending mode is referred as a vertical bending mode. This invention reinforces the frame 14 in a manner which resists at least in plane bending of the screen frame members 16, 18.

According to this invention, reinforcement of the screen frame 14 is accomplished by providing at least those frame members 16, 18 that are subject to detrimental bending, such as the long frame members 16 in FIG. 1, with a unique truss construction or configuration. In the particular frame illustrated, all four frame members 16, 18 of the frame are reinforced. More specifically, the frame members 16, 18 are truss frame members which resist primarily the in-plane bending mode of the frame 14, that is inward bending or bowing of the frame members 16, 18 in the plane of the frame by the tension forces in the stretched printing screen 12.

Each truss frame member 16, 18 of the screen frame 14 comprises laterally spaced inner and outer longitudinal load bearing truss portions 24, 26 and additional lateral load bearing truss portions 28, 30 extending between and rigidly joining the longitudinal truss portions 24, 26 in such a way as to form a plurality of generally triangular load bearing truss sections 34. The inner longitudinal truss portions 24 are located along and define the adjacent edges of the frame opening 22. The frame reinforcing truss structures, i.e. truss frame members 16, 18, are disposed in the plane of the frame 14 so as to resist primarily inward bending of these frame members in the plane of the frame when the printing screen 12 is stretched edgewise as described below. These truss structures also resist the vertical bending mode of the frame 14 to some extent, of course.

The screen gripping and tensioning means 20 are mounted on and extend along certain of the longitudinal truss portions of the truss frame members 16, 18. In the preferred screen frame structure illustrated, these screen gripping and tensioning means are mounted on and extend along the outer longitudinal truss portions 26 to achieve the frame size and weight reductions discussed below. The illustrated screen gripping and tensioning means comprise screen gripping rollers 36, 38 which are positioned within and extend through longitudinal cavities 40 in the outer longitudinal truss portions 26. These cavities open laterally through the normally bottom sides (i.e. the upper sides in the drawings) of the outer longitudinal truss portions 26 in such a way as to provide normally bottom surfaces 41 along the inner longitudinal edges of the cavities. The truss portion surfaces 41 are disposed in a common plane parallel to the plane of the frame 14. At he ends of the rollers are threaded coaxial shafts 42 which extend through slots 44 in end walls 46 at the ends of the cavities 40 to rotatably support the rollers on the frame for turning on the longitudinal axes of their respective cavities. Threaded on each roller shaft 42 at opposite sides of the adjacent roller cavity end wall 46 are nuts 48 and 50. Each inner nut 48 is disposed within a recess 52 in the respective outer longitudinal truss portion which is sized to receive a wrench for engaging the inner nut. The frame 14 has corner openings 54 to receive a wrench for engaging the outer nuts 50.

Each roller 36, 38 has means 56 for gripping an edge of the printing screen 12, and its end shafts 42 are reverse threaded, all in the same manner as explained in my application Ser. No. 07/564,752, whereby the rollers may be rotated to tension the printing screen 12 edgewise and then secured against rotation to retain the screen tension by wrenches engaging the roller nuts 48 and 50. As shown best in FIG. 2, each edge portion of the printing screen 12 extends outwardly across and in contact with the surface 41 of the respective outer longitudinal truss portion 26 and then through the open side of the respective truss portion cavity 40 into engagement with the screen gripping means 56 of the respective roller 36, 38. Accordingly, the tension in the screen creates laterally inward forces on the truss frame members 16, 18 which tend to bend or bow these members inwardly in the plane of the frame 14 between their ends. As explained earlier, such inward bending or bowing of the frame members creates non-uniform tension in the screen and resulting distortions in screen prints made with the frame structure. The sides of the roller cavities 40 and the sides of the roller shaft slots 44 incline outwardly away from the frame opening 12 toward the open sides of the cavities and the open ends of the slots in such a way as to restrain the rollers 36 from being pulled from the cavities by the screen tension.

The truss configuration or construction of the truss frame members 16, 18 is designed to resist such inward bending or limit any inward bending which does occur to such a small amount that it does not adversely effect the screen prints. It will be understood, of course, that while all four frame members 16, 18 of the illustrated screen frame 14 are reinforcing trusses, the dimensions of some frames may be such as to require reinforcing trusses along only two opposite frame sides (i.e. the longer sides).

As mentioned earlier, only a central portion of the screen 12 is useable for printing. The remaining border-like edge portion of the screen about this central screen portion and between the latter and the gripped edges of the screen is not useable for printing for the reasons explained previously. In the drawings (FIG. 2), this unuseable border portion of the screen is designated by the reference numeral **12*a*. One unique feature of the screen frame structure 10 of this invention resides in the fact that almost the entire width of the truss frame members 16, 18, (actually the entire truss width except for the laterally outer halves of their outer longitudinal truss portions 26) are located inwardly of the gripped edges of the screen and directly opposite the unuseable screen portion 12*a*, (i.e. directly above the unuseable screen portion in the normal printing position of the frame structure 10 and directly under the unuseable screen portion as the frame structure is viewed in the drawings). Locating the truss structures inwardly of the gripped screen edges and opposite the unuseable screen portion 12*a* in this way obviously results in a screen frame 14 whose overall size and weight are substantially less than those of a comparable screen size frame whose truss frame members are located outwardly of the gripped screen edges. Moreover, this size and weight reduction is accomplished without diminishing the useable printing area of the screen 12. As shown in FIGS. 2 and 3, the surfaces 58 of the truss frame members 16, 18 which face the screen 12 inwardly of the screen engaging surfaces 41 on the outer longitudinal truss portions 26 are offset from the plane of the surfaces 41** so as to be spaced from the screen.

Another unique feature of the frame 14 resides in the fact that all of the frame surfaces are either sustantially parallel to the plane of the frame or substantially normal to this plane or rounded in such a way that the frame may be cast in one piece from a suitable material, such as aluminum. It will be evident to those skilled in the art, however, that the frame may also be fabricated from several separate parts which are rigidly bolted, welded, or otherwise joined to one another.

Figure 4:
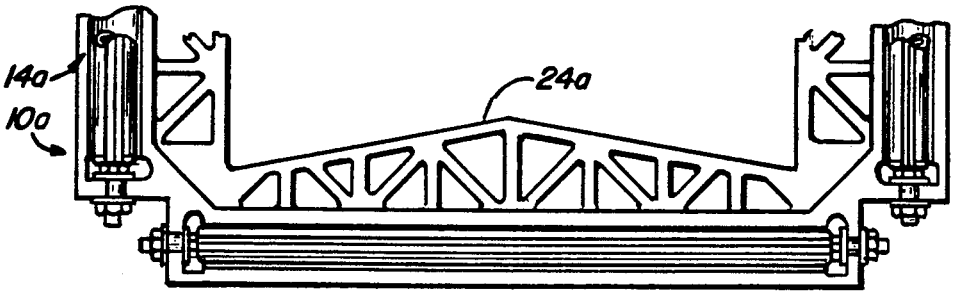
FIG. 4 is a fragmentary plan view of a modified reinforced screen printing frame structure according to the invention.

FIG. 4 illustrates a screen frame structure **10*a* which is identical to that of FIGS. 1–3 except that the truss frame members 16*a* along the longer sides of the screen frame 14*a* have a peaked configuration such that the bending strength of these truss frame members increases from their ends to their longitudinal centers. To this end, the inner longitudinal truss portions 24*a* of the truss frame members 16*a* have angled end portions which diverge from their respective outer longitudinal truss portions 26*a*** from the ends to the longitudinal centers of the longitudinal truss portions.

It is evident at this point that a screen frame structure according to this invention may be regarded as comprising (a) frame portions proper which form an open rectangular frame, mount the screen gripping means, and have inner and outer sides facing toward and away from the frame opening, respectively, and (b) reinforcing truss means along one of these sides of such frame forming portions which resist bending thereof at least in the plane of the frame. In the preferred embodiments shown in the drawings, the frame forming portions (a) are the outer longitudinal truss portions **26, 26*a*, and the reinforcing truss means (b) comprise the inner longitudinal truss portions 24, 24*a*** and the lateral truss portions.

I claim:

1. A screen printing frame structure comprising:

an open rectangular fame having a normal printing position in which one side of the frame is lowermost and including frame members along the four sides, respectively, of said frame rigidly joined to one another at the frame corners and forming a rectangular opening through the frame, the frame member along each of at least two opposite sides of said frame comprising an open truss having an open truss configuration and including an inner longitudinal load bearing truss portion extending along and bounding the adjacent side of said frame opening and rigidly joined at its ends to the frame members along the two remaining sides of said frame, each of said inner truss portions having an outer longitudinal load bearing truss portion laterally spaced from said inner truss portion in a direction away from said opening at least between the ends of said truss portions and rigidly joined at its ends to the frame members along said two remaining sides of said frame, and additional lateral load bearing truss portions extending between and integrally and rigidly joined to said inner and outer truss portions, and screen gripping and tensioning means mounted on and extending along one longitudinal truss portion of each truss for stretching a printing screen edgewise across one side of said frame.

2. A screen printing frame structure according to claim 1, wherein:

said screen gripping and tensioning means on each truss comprises a roller rotatably mounted on said one truss portion of the respective truss with the rotation axis of the roller extending lengthwise of the respective truss, and means for securing an edge of a printing screen to said roller.

3. A screen printing frame structure according to claim 1, wherein:

said one longitudinal truss portion of each truss has a laterally opening longitudinal cavity containing the respective screen gripping and tensioning means.

4. A screen printing frame structure according to claim 1, wherein:

said one longitudinal truss portion of each truss has a longitudinal cavity opening laterally to said one side of said frame and containing the respective screen gripping and tensioning means.

5. A screen printing frame structure according to claim 1, wherein:

said one longitudinal truss portion of each truss has a cavity opening laterally to said one side of said frame and containing the respective screen gripping and tensioning means, and said screen gripping and tensioning means on each truss comprises a roller rotatable within said cavity in the respective truss with the rotation axis of the roller extending lengthwise of the respective cavity, and means for securing an edge of a printing screen to said roller.

6. A screen printing frame structure according to claim 1 wherein:

said one longitudinal truss portion of each truss is said outer longitudinal truss portion.

7. A screen printing frame structure according to claim 6, wherein:

said outer longitudinal truss portion of each truss has a laterally opening longitudinal cavity containing the respective screen gripping and tensioning 8. A screen printing frame structure according to claim 6, wherein:

said outer longitudinal truss portion of each truss has a longitudinal cavity opening laterally to said one side of said frame and containing the respective screen gripping and tensioning means.

9. A screen printing frame structure according to claim 6, wherein:

said outer longitudinal truss portion of each truss has a longitudinal cavity opening laterally to said one side of said frame, and said screen gripping and tensioning means on each truss comprises a roller rotatable within said cavity in the respective truss with the rotation axis of the roller extending lengthwise of the respective cavity, and means for securing an edge of a printing screen to said roller.

10. A screen printing frame structure according to claim 6 wherein:

a printing screen when stretched across said frame has a central portion which is useable for printing and a border-like edge portion about said useable central portion which is unuseable for printing, and said inner longitudinal truss portions and said additional truss portions are disposed to overlie said unuseable screen portion said frame occupies its normal printing position.

11. A screen printing frame structure according to claim 6 wherein:

a printing screen stretched across said frame has a central portion which is useable for printing and a border-like edge portion about said useable central portion which is unuseable for printing, said outer longitudinal truss portions have longitudinal screen engaging edges at said one side of said frame located between said screen gripping and tensioning means and said frame opening and disposed in a common plate parallel to the plane of the frame for engagement with the screen between said screen gripping and tensioning means and said frame opening, and said inner longitudinal truss portions and said additional truss portions are situated between said screen engaging edges and said frame opening so as to overlie said unuseable screen portion and have surfaces at said one side of said frame which are spaced from said common plane so as to be disposed in spaced confronting relation to said unuseable screen portion.

12. A screen printing frame structure according to claim 6, wherein:

a screen stretched across said frame has a central portion which is useable for printing and a border-like edge portion about said useable central portion which is unuseable for printing, said outer longitudinal truss portion of each truss has a longitudinal cavity opening laterally to said one side of said frame, said screen gripping and tensioning means on each truss is disposed within said cavity in the respective outer longitudinal truss portion, said outer longitudinal truss portions have longitudinal screen engaging edges along the inner sides of their respective cavities located in a common plane parallel to the plane of the frame for engagement with the screen between said screen gripping and tensioning means and said frame opening, and said inner longitudinal truss portions and said additional truss portions are situated between said screen engaging edges and said frame opening so as to overlie said unuseable screen portion when said frame occupies its normal printing position, and said inner longitudinal truss portions and said additional truss portions have surfaces which are located at said one side of said frame and are spaced from said common plane so as to be disposed in spaced confronting relation to said unuseable screen portion.

13. A screen printing frame structure according to claim 1, wherein:

said one longitudinal truss portion of each truss is the respective outer truss portion, said outer longitudinal truss portions are straight, and said inner longitudinal truss portions diverge from the respective outer longitudinal truss portions from the ends to the centers of the respective longitudinal truss portions, whereby said trusses have a peaked configuration.

14. A screen printing frame structure according to claim 1, wherein:

each frame member comprises a said open truss, said inner longitudinal truss portions are integrally and rigidly joined to one another at the corners of said frame, and said outer longitudinal truss portions are integrally and rigidly joined to one another at the corners of said frame.

15. A screen printing frame structure according to claim 12, wherein:

each frame member comprises a said open truss, said inner longitudinal truss portions are integrally and rigidly joined to one another at the corners of said frame, and said outer longitudinal truss portions are integrally and rigidly joined to one another at the corners of said frame.

* * * * *